US008794876B2

(12) United States Patent
Schneider

(10) Patent No.: US 8,794,876 B2
(45) Date of Patent: Aug. 5, 2014

(54) DEVICE AND METHOD FOR SURVEYING JET GROUTING PILES IN THE GROUND

(75) Inventor: Nikolaus Schneider, OT Wildenbruch (DE)

(73) Assignee: GuD Geotechnik und Dynamik GmbH, Berlin (DE)

( * ) Notice: Subject to any disclaimer, the term of this patent is extended or adjusted under 35 U.S.C. 154(b) by 0 days.

(21) Appl. No.: 13/543,404

(22) Filed: Jul. 6, 2012

(65) Prior Publication Data

US 2013/0011207 A1 Jan. 10, 2013

(30) Foreign Application Priority Data

Jul. 6, 2011 (EP) ..... 11172830

(51) Int. Cl.
*E02D 7/24* (2006.01)

(52) U.S. Cl.
USPC ..... 405/232; 405/233; 405/248

(58) Field of Classification Search
USPC ..... 405/269, 232, 233, 248
See application file for complete search history.

(56) References Cited

U.S. PATENT DOCUMENTS 5,361,838 A * 11/1994 Kilgore ..... 166/254.2
5,401,121 A * 3/1995 Nakashima et al. ..... 405/269
5,904,447 A * 5/1999 Sutton et al. ..... 405/269
7,040,402 B2 * 5/2006 Vercaemer ..... 166/253.1
7,192,220 B2 * 3/2007 Gunther ..... 405/269
7,789,591 B2 * 9/2010 Hakkinen et al. ..... 405/269
2005/0063789 A1 * 3/2005 Gunther ..... 405/269
2009/0178849 A1 7/2009 Schneider
2010/0178115 A1 * 7/2010 McVay et al. ..... 405/237
2013/0064610 A1 * 3/2013 Leiner et al. ..... 405/266

FOREIGN PATENT DOCUMENTS

DE 19521639 A1 5/1996
EP 0581686 A1 2/1994
WO WO-2007/101500 A1 9/2007

OTHER PUBLICATIONS

European Search Report issued in counterpart Application No. 11172830.9 dated Oct. 28, 2011.

* cited by examiner

*Primary Examiner* — Frederick L Lagman
(74) *Attorney, Agent, or Firm* — Venable LLP; Robert Kinberg

(57) ABSTRACT

A device and a method for surveying jet grouting piles in a subsoil, which is suitable for a drilling and grouting linkage assembly for creating a hole and a jet grouting pile in a region of the hole. A measurement device is integrated in the drilling and grouting linkage assembly and comprises a scanning element that is movable from a retracted position to an extended position. The scanning element is deflected inside the measurement device through a retraction and extension housing mounted on the measurement device. The scanning element comprises at least in segments a shape-memory alloy.

13 Claims, 3 Drawing Sheets

DEVICE AND METHOD FOR SURVEYING JET GROUTING PILES IN THE GROUND

CROSS-REFERENCE TO RELATED APPLICATIONS

Priority is claimed to European Patent Application No. EP 11 172 830.9, filed Jul. 6, 2011, the disclosure of which is incorporated herein by reference, in its entirety.

AREA OF THE INVENTION

The present invention concerns a device and a method for surveying jet grouting piles in the ground, which is suitable for a drilling and grouting linkage assembly for creating a hole, and a jet grouting pile in the region of the hole.

PRIOR ART

The method for producing jet grouting piles is a method of special excavation in which an energy-rich, high pressure jet of water and/or binder emerges from a rotating drilling and grouting linkage assembly and thus destroys the stratification of the surrounding soil and turns it into mortar by the addition of binder. In this context it is desirable to monitor the quality of the jet grouting pile and hence the work result. For this there is a possibility of providing a measuring device during processing, for example on the drilling and grouting linkage assembly.

A known drilling and grouting linkage assembly with a measurement device is disclosed in European Patent Application EP 1 974 122 A1 (published as WO2007/101500 and US2009178849 A1). The known device comprises a drilling and grouting linkage assembly to create a hole and a jet grouting pile in the region of the drilling hole, and a measurement device for surveying the jet grouting pile, wherein this measurement device is at least partly integrated in the drilling and grouting linkage assembly. With such a device it is possible to monitor the quality of the jet grouting piles in a flexible and reliable manner during operation of the drilling and grouting linkage assembly.

SUMMARY OF THE INVENTION

An object of the present invention is to provide a measuring device for assessing a jet grouting pile which is easier to handle than the prior art and in particular takes up less space.

The above and other objects are achieved by a measurement device adapted for integration in a drilling and grouting linkage assembly used to create a hole and a jet grouting pile in a region of the hole, wherein the measurement device is used for surveying the jet grouting pile. The measurement device includes: a hollow body; a retraction and extension housing mounted on the hollow body; and a scanning element movable from a retracted position into an extended position and being deflectable inside the measurement device through the retraction and extension housing, wherein the scanning element includes a rod or cable and a sensor attached at an end of the cable or rod, wherein the rod or cable at least in segments comprises a shape-memory alloy.

In an embodiment, the sensor has properties preferred for the required use and the scanning element is advantageously integrated and guided in the drilling and grouting linkage assembly.

In one embodiment, a measurement device is provided for a drilling and grouting linkage assembly. The drilling and grouting linkage assembly is intended to create a hole and a jet grouting pile in the region of the hole. This means that with the drilling and grouting linkage assembly, first a hole is made in the subsoil/soil, and the soil is softened at a suitable depth (jet grouting pile).

The measuring device according to the invention is also intended for surveying a jet grouting pile, in particular for measuring the diameter of the jet grouting pile, and the measuring device is integrated in the drilling and grouting linkage assembly. Furthermore the measurement device has a scanning element including a sensor, that can move from a retracted position to an extended position, and is deflected within an extension and retraction housing fitted on the measurement device. According to an embodiment, the rod or cable of the scanning element comprises at least in segments a shape-memory alloy. Preferably this is a metal alloy of nickel titanium. A variant of this metal alloy is known under the name Nitinol. Such materials surprisingly have advantageous properties for use in excavation/special excavation work. The scanning element is flexible for deflection but outside the measurement device, i.e. within the jet grouting pile, resists the external conditions and can thus guide the sensor into the jet grouting pile for measurement.

In a further embodiment the scanning element can be deflected by an angle of substantially 90°. This has the advantage that the scanning element is guided within the drilling and grouting linkage assembly and can be moved laterally out of the drilling and grouting linkage assembly.

The sensor of the scanning element can be a pressure and/or tilt sensor. Furthermore with such a sensor the diameter of the jet grouting pile can be determined, wherein the tilt sensor can ensure a valid measurement. The sensor may comprise several combined individual sensors. However in an alternative embodiment it is possible that measurement is performed with the scanning element and a further device in order to assess the jet grouting pile. In particular on extension of the scanning element, by monitoring the motor power it can be established when the scanning element has reached the wall of the jet grouting pile: if the current consumption of the motor increases and at the same time no increase is established in the extended length of the scanning element, then the scanning element has reached the wall of the jet grouting pile.

The measures described for detection and evaluation of the jet grouting pile can also be used in combination with each other.

The scanning element including the sensor may be retracted and extended in operation of the device according to the invention through the opening of the retraction and extension housing mounted on the measurement device. In one embodiment the sensor is designed, amongst others dimensioned, such that it seals the opening of the retraction and extension housing in the retracted state.

In a further embodiment of the measurement device, rollers are provided inside the measurement device which deflect the scanning element. The rollers provide a safe deflection with little susceptibility to error, wherein on transport over the rollers, the scanning element is not substantially changed externally (i.e. for example not deformed).

In a further embodiment the scanning element is sealed in relation to the drilling and grouting linkage assembly. However the scanning element is protected inside the drilling and grouting linkage assembly against dirt and contamination which can cause friction on movement.

In particular a flushing channel can be provided in the retraction and extension housing through which the scanning element can be flushed with water or a suspension on retraction and extension. This facilitates the sealing process and ensures that no contaminants can enter the drilling and grouting linkage assembly.

In a further variant of the measurement device, a drive device is provided in this with which the scanning element can be driven. The force may be applied in the region of the deflection of the scanning element. This guarantees safe retraction and extension of the scanning element into and out of the measurement device.

In another embodiment, the scanning element may be curved before its deflection. This pre-curvature can, for example, be provided with the first roller in the region of the deflection. Thus the scanning element is not deflected directly in the direction which leads to the outlet point of the scanning element from the measurement device, but against this direction. This facilitates the movement of the scanning element and under certain circumstances a greater deflection radius can be achieved within the measurement device when the scanning element is pre-curved further towards the wall of the measurement device. This pre-curvature also achieves the stabilisation of the scanning element.

The cable portion of the scanning element may comprise a nickel titanium alloy, for example an alloy known under the name of Nitinol. This is particularly suitable for the required properties for the scanning element.

Furthermore the present invention comprises a drilling and grouting linkage assembly to create a hole, wherein the drilling and grouting linkage assembly has a nozzle device and attached thereto a measurement device according to one of the variants described above. Furthermore a drill bit can be attached to the measurement device, in particular via an adapter mounted in between. A hole is created with the drill bit and the nozzle device may be used to form a jet grouting pile.

As well as the measurement device according to the invention and the drilling and grouting linkage assembly comprising this measurement device, the present invention also comprises a method for measuring a jet grouting pile. This method can be carried out in one embodiment with a measurement device according to the invention or with the drilling and grouting linkage assembly according to the invention.

BRIEF DESCRIPTION OF THE DRAWINGS

The present invention is described below with reference to a preferred embodiment. This embodiment is explained in detail in the context of the attached drawings.

DETAILED DESCRIPTION

Figure 1:
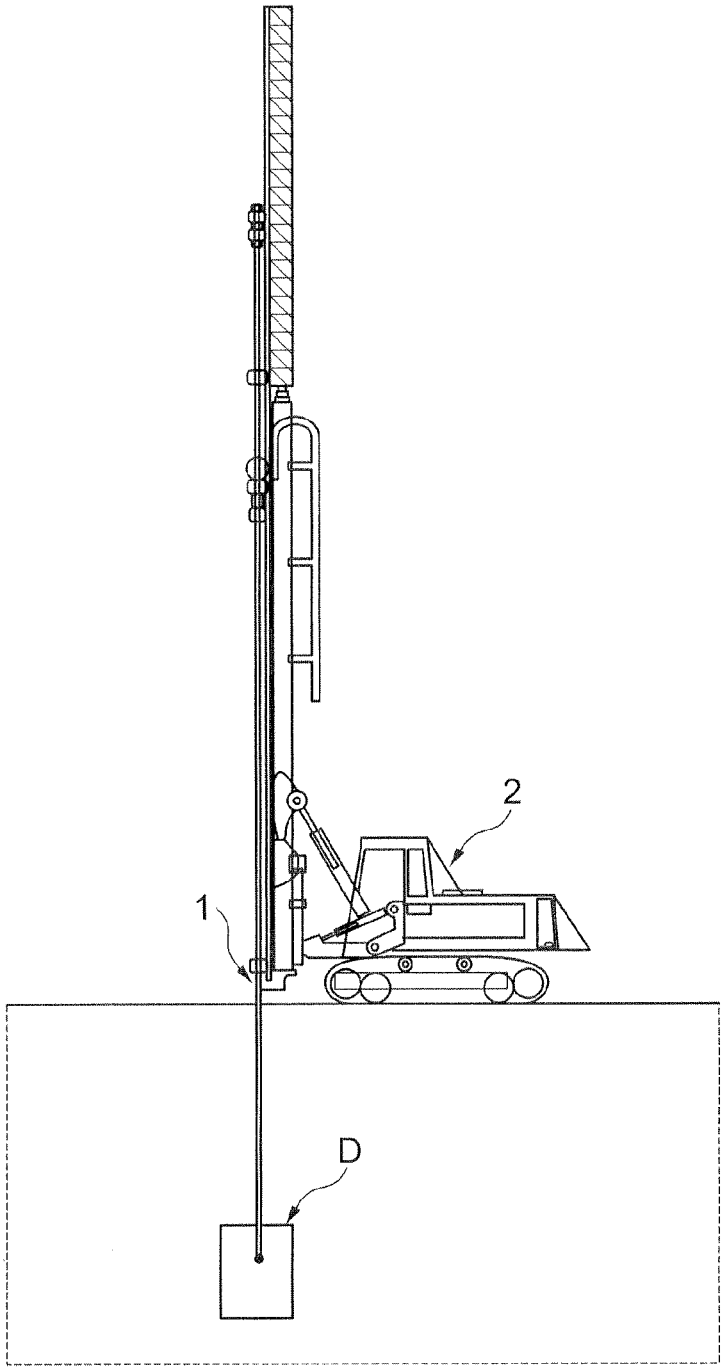
FIG. 1 shows an overall view of a drilling and grouting linkage assembly with a measurement device according to the invention mounted on a drill.

FIG. 1 shows diagrammatically an overall view of a drilling and grouting linkage assembly 1. The drilling and grouting linkage assembly 1 here is mounted on a mobile machine 2 and in the depiction in FIG. 1 already introduced into the ground. At a particular depth, using a nozzle device described later, a jet grouting pile D is introduced into the soil. Here the original stratification of the soil is changed by the energy-rich, high pressure jet and at the same time or with a time delay it is filled with a suspension so that underground reinforcement bodies are produced which can be used as sealing elements or as supporting elements or as sealing and supporting elements.

Figure 2:
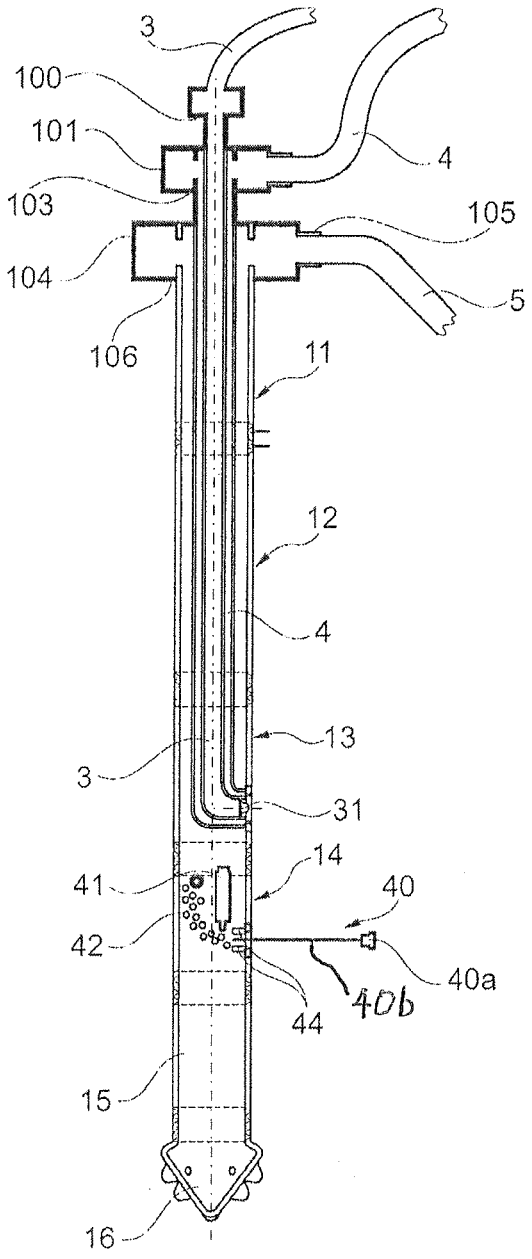
FIG. 2 is a functional view of the drilling and grouting linkage assembly with a drill bit, the nozzle device, adapter and measurement device.
Figure 3:
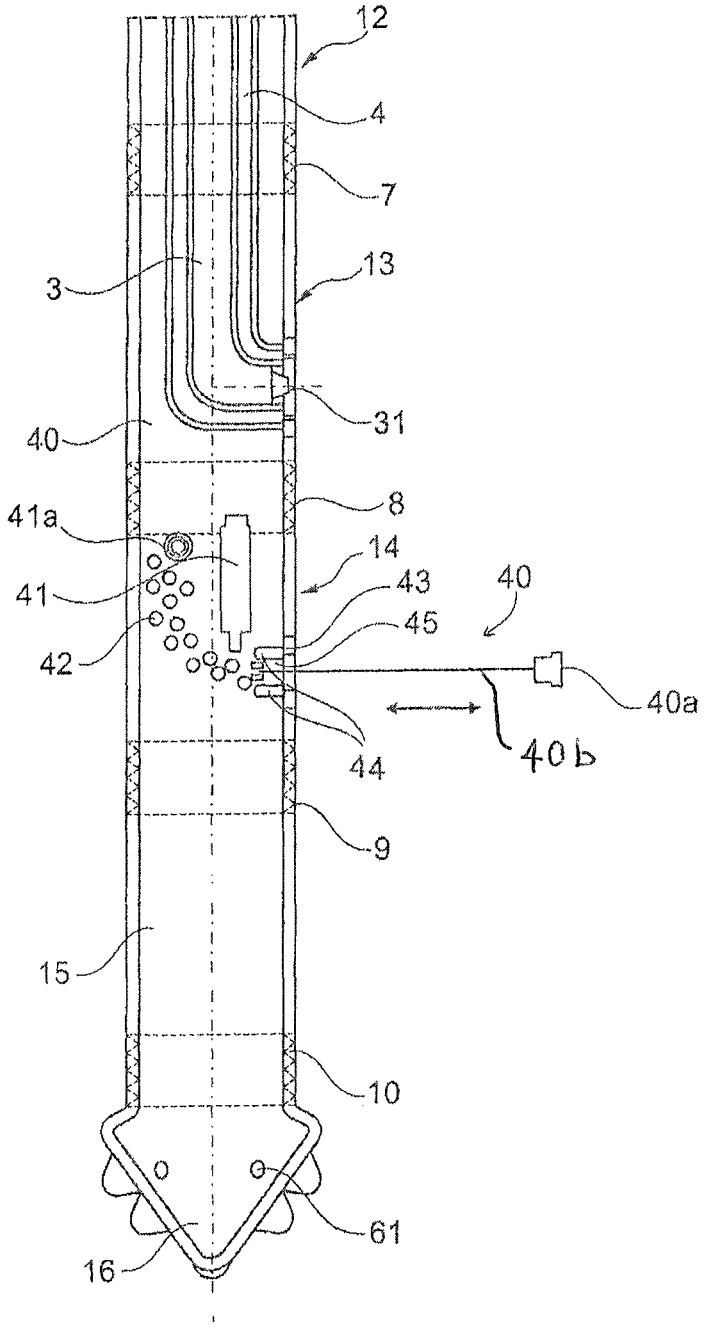
FIG. 3 shows an enlarged view of the region of the drilling and grouting linkage assembly of FIG. 1 in which the measurement device and the jet grouting nozzle are shown enlarged.

FIG. 2 shows a functional view of a drilling and grouting linkage assembly 1. This comprises various segments, namely a connecting segment 11, an intermediate segment 12, a nozzle device 13, a measuring device 14, an adapter 15 and a drill bit 16. These elements are arranged in the corresponding order and connected by threaded connectors. FIG. 3 shows in detail the threads 7, 8, 9 and 10 between the segment 12, the nozzle device 13, the measurement device 14, the adapter 15 and the drill bit 16. A high pressure suspension line 3 for the high pressure suspension, a line 4 for air and a line 5 for the drill flusher are routed to the drilling and grouting linkage assembly 1.

At the connection of the line 3 for the high pressure suspension is provided a bearing/seal 100. On an attachment 101 to line 4 is also provided a bearing/seal 102 and a further bearing/seal 103. The line 5 for the drill flusher is mounted on an attachment 104 with a 2" hose connection 105. Furthermore a bearing/seal 106 is provided between attachment 104 and the drilling and grouting linkage assembly 1, in particular segment 11.

FIG. 3 shows part of the nozzle device 13 mounted on segment 12 and measuring device 14 in detail. The nozzle device 13 and the measuring device 14 are coupled detachably together in this embodiment by a screw connection 8.

The nozzle device 13 is intended for application under high pressure of a high pressure suspension supplied via a high pressure line 3. The working fluid for supporting the high pressure suspension is preferably air, which is supplied through a further line 4.

In the present embodiment screw connections 7 to 10 are provided. Sealing rings ensure that no contaminants enter the measuring device 14 for example during operation. As an alternative to the screw connections 7 to 10, individual radially acting bolts can be provided with which for example the measurement device 14 is bolted to the nozzle device 13. Other plug connections are also conceivable.

Guided in the measurement device 14 is a scanning element 40 comprising a rod or cable **40*b* and a sensor 40*a*** attached an end of the rod or cable, the sleeve of which rod or cable in the present embodiment comprises a nickel titanium alloy. This nickel titanium alloy belongs to the group of shape-memory alloys and is known under the name Nitinol. Usually such materials are used in the field of medical technology. However in the present development work it was found that Nitinol is surprisingly suitable also for devices which are used in the field of excavation or special excavation work.

The scanning element 40 is guided parallel to the high pressure suspension line 3 and accommodated in the measurement device 14. For this in a region of the measurement device 14 pointing towards the nozzle device 13, a motor 41 is provided with which the scanning element 40 can be driven. The drive force is transmitted via a drive roller **41*a* to the scanning element 40**.

Furthermore the scanning element 40 in the region of the measurement device is deflected from a vertical direction into horizontal direction. "Vertical" in the sense of the present application means a direction along the drilling and grouting linkage assembly 1 whereas a "horizontal" direction is oriented perpendicular to this.

Several rollers 42 are provided inside the measurement device 14 such that the scanning element 40 is guided substantially at an angle of 90° in relation to the guide parallel to the high pressure suspension channel 3. In this context FIG. 2 shows that before deflection of the scanning element 40, a pre-curvature is produced, namely before the first roller 42 in the feed direction. In this way the deflection of the scanning element 40 by an angle of 90° which takes place later in the advance direction can be set better in the measurement device.

After the scanning element 40 inside the measurement device 14 has been brought from the vertical direction (path within the nozzle device 13) into a substantially horizontal direction, the scanning element 40 extends through a retraction and extension housing 43. The refraction and extension housing 43 has a sealing element 45 which seals the inside of the measurement device 14 against the outside.

Furthermore the sensor element 40*a* mounted at one end of the rod or cable 40*b* is formed such that it can lie against the opening of the retraction and extension housing 43 and thus alternatively or additionally to the sealing element 45 provide a seal against the inside of the measurement device 14.

The movement of the scanning element 40 in the present embodiment is initiated by means of motor 41 in the region of the deflection of the scanning element 40. Where applicable, alternatively or additionally, individual rollers 42 can also be driven. Furthermore in the region of the drilling and grouting linkage assembly, further integrated motors can be provided. The drives are excited for example via the battery operation of the measurement system.

For measurement the scanning element 40 is moved away from the sealing device 45 and enters the horizontal direction, and is introduced into the jet grouting pile not yet hardened. For example the scanning element 40 can be extended up to 2 m out of the sealing device. The inherent rigidity of the scanning element 40 and the support from the sealed rod allows it to maintain a substantially horizontal direction even outside the measurement device 14.

Initialisation of the measurement process using the scanning element takes place by means of body-borne sound pulses which are initiated in the drilling and grouting linkage assembly 1 or by radio transmission. The steps for surveying a jet grouting pile in the ground can then take place as follows. In a first step a suitable drill contact point is established. In a further working step the drilling and grouting linkage assembly 1 is brought to the new drill contact point and then the drilling and grouting linkage assembly 1 is lowered to a desired depth by means of drilling, wherein accompanying the drilling, the hole course can be measured by the integral tilt sensors.

After reaching the desired drilling depth, a jet grouting pile is created in the region of the hole and the diameter of the jet grouting pile produced is measured at different heights. The scanning element 40 is moved in the jet grouting pile which has not yet hardened. The scanning element 40 is advantageously designed so that because of the drive, its inherent rigidity, its own weight and the lift, it can be held substantially horizontally. The data detected and stored by the scanning element 40 can be read in parallel to measurement or with a time delay on raising of the drilling and grouting linkage assembly from the hole. From this data, concrete information can be obtained on the composition of the soil and the resulting composition of the jet grouting pile produced. These results can be used for further calculations.

When measurement has been carried out, the scanning element 40 on retraction into the measurement device 14 is flushed with water pressure via the flushing channel 45 provided on the retraction and extension housing 43, and during retraction sealed against the liquid medium in the hole and the pile. The water flushing before the retraction and extension housing 43 thus facilitates the sealing process and ensures that no contamination can penetrate inside the measurement device 14.

The drill bit 16 can for example be connected directly to the measurement device 14. Alternatively as shown in the present embodiment, an adapter 15 can be provided between the measurement device 14 and the drill bit 16. Instead of an adapter 15, several elements can also be provided between the measurement device 14 and the drill bit 12.

The drill bit 16 has openings 61 for a drill flusher. From these openings 61 a fluid emerges from the drill bit and thus allows penetration of the drilling and grouting linkage assembly 1 into the ground/soil.

The invention claimed is:

1. A measurement device adapted for integration in a drilling and grouting linkage assembly used to create a hole and a jet grouting pile in a region of the hole, wherein the measurement device is for surveying the jet grouting pile, the measurement device comprising:

a hollow body;

a retraction and extension housing mounted on the hollow body;

a scanning element movable from a retracted position into an extended position and being deflectable inside the hollow body of the measurement device through the retraction and extension housing, wherein the scanning element comprises a sensor and a rod or cable having an end at which the sensor is attached, and wherein the rod or cable at least in segments comprises a shape-memory alloy.

2. The measurement device according to claim 1, wherein the scanning element is deflectable through an angle of substantially 90°.

3. The measurement device according to claim 1, wherein the sensor measures at least one of pressure and tilt.

4. The measurement device according to claim 3, wherein the sensor in the retracted position seals an opening of the retraction and extension housing.

5. The measurement device according to claim 1, further including rollers arranged inside the hollow body of the measurement device to deflect the scanning element.

6. The measurement device according to claim 1, wherein the scanning element is sealed in relation to the drilling and grouting linkage assembly.

7. The measurement device according to claim 1, wherein the retraction and extension housing includes a flushing channel through which the scanning element, on retraction and extension, can be flushed with a fluid.

8. The measurement device according to claim 1, further including a drive device arranged in a inside the hollow body of the measurement device to drive the scanning element in a region of deflection of the scanning element.

9. The measurement device according to claim 1, wherein the scanning element is pre-curved in another direction before its deflection.

10. The measurement device according to claim 1, wherein the shape-memory alloy is a nickel titanium alloy.

11. A drilling and grouting linkage assembly to create a hole, comprising a nozzle device and a measurement device according to claim 1 attached to the nozzle device.

12. A drilling and grouting linkage assembly according to claim 8, further comprising a drill bit attached to the measurement device.

13. A method for measuring a jet grouting pile carried out after introduction of a drilling and grouting linkage assembly into a subsoil, comprising the steps of:

extending a scanning element including a sensor from a measurement device integrated in a drilling and grouting linkage assembly;

initializing a measurement process by body-borne sound transmission or radio transmission;

recording a measurement value, and retracting the scanning element into the measurement device while using a fluid flush.

* * * * *